US005760639A

United States Patent [19]

Hall

[11] Patent Number: 5,760,639

[45] Date of Patent: Jun. 2, 1998

[54] VOLTAGE AND CURRENT REFERENCE CIRCUIT WITH A LOW TEMPERATURE COEFFICIENT

[75] Inventor: Jefferson W. Hall, Phoenix, Ariz.

[73] Assignee: Motorola, Inc., Schaumburg, Ill.

[21] Appl. No.: 610,022

[22] Filed: Mar. 4, 1996

[51] Int. Cl.[6] ..... G05F 3/16; G05F 3/22

[52] U.S. Cl. ..... 327/539; 327/513; 327/542; 323/314

[58] Field of Search ..... 323/907, 315, 323/314, 313; 327/539, 513, 541, 540, 535, 103, 538, 543, 542, 530

[56] References Cited

U.S. PATENT DOCUMENTS

| | | | |
|---|---|---|---|
| 4,349,778 | 9/1982 | Davis | 323/314 |
| 4,443,753 | 4/1984 | McGlinchey | 323/315 |
| 4,626,770 | 12/1986 | Price, Jr. | 323/313 |
| 4,786,856 | 11/1988 | Metcalf et al. | 323/907 |
| 4,816,742 | 3/1989 | Van De Plassche | 323/907 |
| 4,939,442 | 7/1990 | Carvajal et al. | 323/907 |
| 5,001,362 | 3/1991 | Tran | 327/103 |
| 5,124,632 | 6/1992 | Greaves | 323/316 |
| 5,173,656 | 12/1992 | Seevinck et al. | 323/314 |
| 5,208,527 | 5/1993 | Poletto et al. | 323/907 |
| 5,293,112 | 3/1994 | Takahashi | 323/907 |
| 5,304,918 | 4/1994 | Khieu | 323/907 |
| 5,307,007 | 4/1994 | Wu et al. | 323/313 |
| 5,339,020 | 8/1994 | Siligoni et al. | 323/313 |
| 5,391,980 | 2/1995 | Thiel et al. | 323/314 |
| 5,453,679 | 9/1995 | Rapp | 323/315 |
| 5,455,504 | 10/1995 | Suzuki et al. | 323/907 |
| 5,497,073 | 3/1996 | Böhme et al. | 323/313 |
| 5,557,194 | 9/1996 | Kato | 327/542 |
| 5,570,008 | 10/1996 | Goetz | 323/315 |

FOREIGN PATENT DOCUMENTS

| | | | |
|---|---|---|---|
| 0524154 | 5/1992 | European Pat. Off. | G05F 3/22 |
| 0629938 | 6/1994 | European Pat. Off. | G05F 3/30 |

OTHER PUBLICATIONS

Paul Gray et al., "Analysis and Design of Analog Integrated Circuits," John Wiley & Sons, 1984 (2nd Edition), pp. 289–296.

*Primary Examiner*—Timothy P. Callahan
*Assistant Examiner*—Terry L. Englund
*Attorney, Agent, or Firm*—Gary W. Hoshizaki; Sharon K. Coleman

[57] ABSTRACT

A voltage and current reference circuit (11) having a low temperature coefficient is provided. The voltage and current reference circuit (11) minimizes component count to reduce area on an integrated circuit die. A bandgap voltage reference (12) produces a low temperature coefficient voltage. A voltage follower (13) is coupled to the bandgap voltage reference (12) that produces a reference voltage corresponding to a bandgap voltage. A temperature variant current from the bandgap voltage reference (12) is mirrored and provided to a first electrode of the voltage follower (13). A resistor (R4) is coupled between a power supply terminal and a second electrode of the voltage follower (13). The resistance of the resistor (R4) is selected to generate a current that cancels temperature dependencies of the temperature variant current. A current mirror circuit (14) receives a remaining portion of the temperature variant current and outputs a low temperature coefficient current.

19 Claims, 2 Drawing Sheets

VOLTAGE AND CURRENT REFERENCE CIRCUIT WITH A LOW TEMPERATURE COEFFICIENT

BACKGROUND OF THE INVENTION

This invention relates, in general, to voltage and current reference circuits, and more particularly, to voltage and current reference circuits having a low temperature coefficient.

In many circuit designs both voltage references and current references are required. A voltage reference provides a fixed voltage over different circuit operating conditions. Similarly, a current reference provides a fixed current over different circuit operating conditions. In particular, a voltage and current reference rejects variations in power supply voltage, loading, and temperature.

One type of voltage reference that is well known by one skilled in art is a bandgap voltage reference. A bandgap voltage reference provides a reference voltage that is approximately the bandgap voltage of silicon (1.2605 volts). The bandgap voltage reference is designed to have a zero temperature coefficient centered in a temperature range of circuit operation. In general, a bandgap voltage reference provides a stable voltage over a wide temperature range, rejects variations in power supply voltage, and is easily designed to drive different loading demands.

It would be of great benefit if a reference circuit could be provided which combines both a voltage and current reference, minimizes component count (thus reducing area), is easily manufactured, and has a low temperature coefficient over a wide temperature range.

DETAILED DESCRIPTION OF THE DRAWINGS

In general, two circuit blocks that are commonly used in most integrated circuit designs are a voltage reference and a current reference. A voltage reference provides a stable voltage that has a low temperature coefficient (TC) and is insensitive to power supply variations. A reference voltage is typically used as a point of comparison against other voltages that are sensed or generated by a circuit. Similarly, a current reference provides a stable current that has a low temperature coefficient (TC) and is insensitive to power supply variations. A reference current is typically mirrored for biasing circuitry of an integrated circuit.

A factor in a design of a voltage reference or a current reference circuit is the size or die area required for the circuits. Typically, a voltage reference or a current reference circuit is ancillary to a main circuit design of an integrated circuit. Reducing the area required for a voltage or current reference circuit provides the benefit of minimizing die size or increasing the area remaining for the main circuit design.

Figure 1:
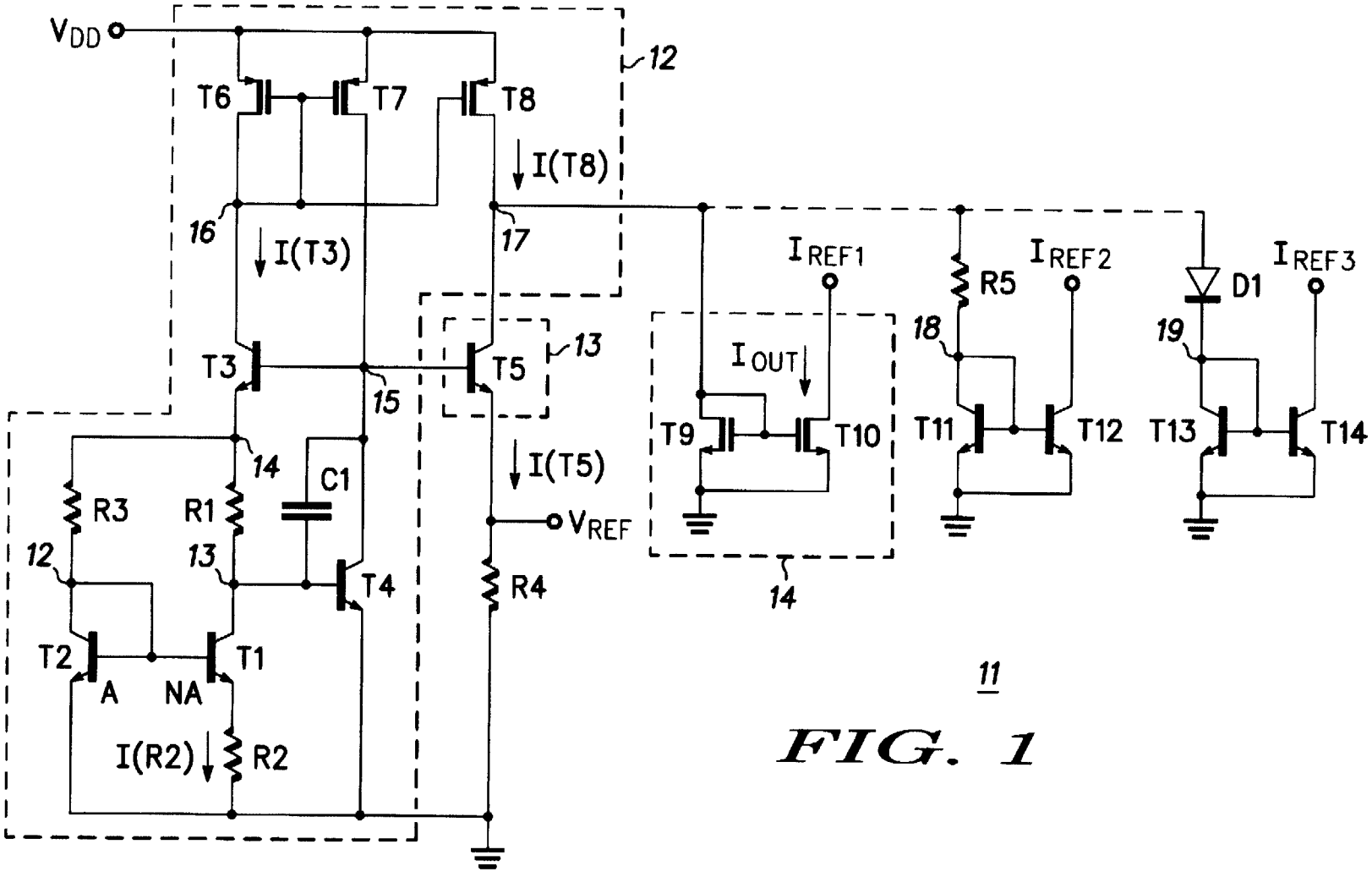
FIG. 1 is a schematic diagram of a voltage and current reference circuit in accordance with the present invention.

An aspect of most voltage reference designs is that they do not inherently produce a low TC current. Similarly, a current reference does not ordinarily produce a low TC voltage. Thus, voltage and current reference circuits are not normally combined but built as separate circuits which is inefficient. If a voltage reference and a current reference could somehow be combined into a single circuit it would reduce area by eliminating redundant circuitry that is required for building separate reference circuits. FIG. 1 is a schematic diagram of a voltage and current reference circuit 11 that minimizes area and has a low temperature coefficient.

The method for generating both a voltage and a current reference includes forming a voltage reference circuit that provides a reference voltage. A first current is also provided from the voltage reference circuit. The first current from the voltage reference circuit has a known temperature coefficient (TC). A second current is generated by using the reference voltage to bias a resistor. Thus, variations due to temperature in the second current are determined by the resistor. The resistor value and current is selected to offset the TC of the first current. In other words, changes in current due to temperature of the first current are matched by changes in the second current. The first current has a current magnitude larger than the second current. The second current is subtracted from the first current such that the remaining current of the first current is a reference current. The remaining current of the first current has a low temperature coefficient due to the temperature dependencies of the second current canceling the temperature dependencies of the first current.

Voltage and current reference circuit 11 comprises transistors T1, T2, T3, T4, T5, T6, T7, T8, T9, and T10, resistors R1, R2, R3, and R4, and a capacitor C1. Transistors T1, T2, T3, T4, and T5 are bipolar NPN transistors having a collector, a base, and an emitter respectively corresponding to a first electrode, a control electrode, and a second electrode. Transistors T6, T7, T8, T9, and T10 are enhancement Metal Oxide Semiconductor Field Effect Transistors (MOSFETs) having a drain, a gate, and a source respectively corresponding to a first electrode, a control electrode, and a second electrode. Transistors T6, T7, and T8 are p-channel enhancement MOSFETs. Transistors T9 and T10 are n-channel enhancement MOSFETs.

A voltage reference 12 generates a reference voltage for voltage and current reference 11. An embodiment of voltage and current reference 11 utilizes a bandgap voltage reference. The bandgap voltage reference comprises transistors T1, T2, T3, T4, T6, T7 and T8, and resistors R1, R2, and R3. Bandgap voltage references are well known by one skilled in the art for providing a reference voltage having a low temperature coefficient. For example, bandgap references are described in "Analysis and Design of Analog Integrated Circuits" by Paul R. Gray and Robert B. Meyer, on pages 289–296, published by John Wiley and Sons, 1984 (2nd Edition) which is hereby incorporated by reference.

A basic bandgap cell is formed by transistors T1, T2, and T4, and resistors R1–R3. Transistor T2 has a collector and base connected in common to a node 12, and an emitter connected to a power supply terminal (e.g. ground). Transistor T2 has a conductive area (A) corresponding to the emitter area of the device. Transistor T4 has a collector connected to node 15, a base connected to node 13, and an emitter connected to ground. Transistor T4 sets a voltage at node 13 to approximately the same voltage as node 12. The bias current provided by transistor T7 to transistor T4 is equal to the sum of the currents biasing transistors T1 and T2. The bandgap voltage is generated by transistor T4 and resistor R1. A resistor R2 has a first terminal and a second terminal connected to ground. Transistor T1 has a collector connected to a node 13, a base connected to node 12, and an emitter connected to the first terminal of resistor R2. Transistor T1 has a conductive area (NA) corresponding to the emitter area of the device N times larger than the conductive area of transistor T2. Resistor R1 has a first terminal connected to a node 14 and a second terminal connected to a node 13. Resistor R3 has a first terminal connected to node 14 and a second terminal connected to the node 12.

The bandgap cell generates a voltage at node 14 corresponding to the bandgap voltage of silicon (approximately 1.2605 volts). In the bandgap cell, the negative temperature coefficient (TC) of a base-emitter junction voltage is canceled by the positive temperature coefficient (TC) of a resistor. The cancellation of temperature dependencies occurs at a temperature determined by the element values. The cell is configured to be stable when identical currents flow through transistors T1 and T2. The circuit is configured such that area ratio between transistors T1 and T2, the resistance of resistor R2, and the base-emitter junction voltage of T4 determines the temperature at which the temperature dependencies cancel. Typically, the temperature at which the temperature coefficients cancel is chosen to be centrally located within the operating temperature range of the integrated circuit in which the bandgap cell resides.

Transistors T3, T6, and T7 form a bias network and feedback loop to drive the bandgap cell to the described stable condition. A start circuit (not shown) is used to establish the desired stable operating point. In an embodiment, a current source momentarily provides a current to node 15 at startup to drive voltage and current reference circuit 11 to the desired stable operating point. Transistor T3 is a low impedance drive stage for the basic bandgap cell. Transistor T3 has a collector connected to a node 16, a base connected a node 15, and an emitter connected to node 14. Transistors T6 and T7 are a current mirror stage. Transistor T6 has a drain and a gate coupled in common to node 16, and a source connected to a power supply terminal (e.g. VDD). Transistor T7 mirrors the current of transistor T6. Transistor T7 has a drain connected to node 15, a gate connected to node 16, and a source connected to VDD. The current mirror stage is implemented with MOSFETs but could equivalently be implemented with bipolar transistors. Transistor T7 has a conductive area equal to the conductive area of transistor T6 to provide a current equal to I(T7)=I(T3)=2*I(R2). The base current of transistor T4 operating at twice the current of transistors T1 and T2 offsets the base currents of transistors T1 and T2 in the bandgap cell.

Transistor T8 mirrors the current of transistor T6 and provides a current I(T8) having a known temperature coefficient. The current I(T3) which biases transistor T6 corresponds to the current I(R2) through resistor R2 of the bandgap cell. In particular, the current I(T8) varies over temperature as the current I(R2) varies. Transistor T8 has a drain connected to a node 17, a gate connected to node 16, and a source connected to VDD.

Transistor T5 is in a voltage follower configuration that provides a reference voltage produced by the bandgap cell at an output Vref. The voltage at output Vref corresponds to the voltage at node 14. Transistor T5 conducts a current I(T5) that has a magnitude determined by resistor R4. Transistor T5 has a collector connected to node 17, a base connected to node 15, and an emitter connected to the output Vref. Resistor R4 has a first terminal connected to the output Vref and a second terminal connected to ground.

Capacitor C1 is a compensation capacitor for voltage and current reference circuit 11 to prevent oscillation. Capacitor C1 provides closed loop stability. Capacitor C1 is connected between nodes 13 and 15. Capacitor C1 forms a dominate pole at node 15 and typically has a value within 5–10 picofarads for a standard integrated circuit process.

The current I(T8) is larger than the current I(T5), thereby generating a difference current which is coupled to a current mirror circuit 14. Current mirror 14 comprises transistors T9 and T10. Transistor T9 has a drain and gate coupled in common to node 17, and a source connected to ground. Transistor T10 has a drain connected to an output Iref1, a gate connected to node 17, and a source connected to ground. Transistor T10 outputs a current Iout that corresponds to the difference current coupled to transistor T9. In an embodiment of voltage and current reference 11, transistors T3 and T5 have equal conductive areas, transistors T6, T7, and T8 have equal conductive areas, and transistors T9 and T10 have equal conductive areas.

Operation of voltage and current reference circuit 11 is described hereinafter. Voltage and current reference circuit 11 provides both a current and a voltage that has a low temperature coefficient (TC). A voltage reference having a bandgap cell is used to generate a low temperature coefficient reference voltage. A first current corresponding to a current from the basic bandgap cell is generated. The current has a known TC based on the characteristics of the bandgap cell. A second current is generated from the reference voltage. The second current has temperature characteristics that cancels the temperature characteristics of the first current. The second current is subtracted from the first current. The remaining current has a low temperature coefficient. An embodiment, of voltage and current reference circuit is described hereinbelow. It should be noted that the values chosen are for illustration purposes and that the element values can be changed for a particular application while still yielding excellent results.

Transistor T1 has a conductive area ratioed to the conductive area of transistor T2. As shown in FIG. 1 transistor T1 has an emitter area N times larger than the emitter area of T2. For illustration purposes N=8. Resistor R2 determines the operating current of the bandgap cell. In this example, resistor R1=resistor R3, the value of resistance of R1 and R3 is also used to adjust the voltage at the output Vref. In this embodiment, a reference voltage equal to the bandgap voltage of silicon (1.2605 volts) is provided at the output Vref.

Initially, the startup circuit provides a current to the base of transistor T3. The startup circuit provides no current after voltage and current reference circuit 11 has stabilized. Transistor T3 provides a current I(T3) when the bandgap cell has stabilized to the desired output. Transistors T1 and T2 are configured such that the base-emitter junction voltage of transistor T2 equals the combined voltages of the base-emitter junction of transistor T1 and the voltage across resistor R2. In particular, transistors T1 and T2 operate at the same current. Transistor T2 operates at a higher current density than transistor T1 due to the conductive area difference between the devices. Thus, operating at the same current, transistor T2 has a larger base-emitter junction voltage than transistor T1. The difference voltage between the base-emitter junctions of transistors T1 and T2 biases resistor R2. The current I(T3) is a current that corresponds to a current of the bandgap cell. Transistor T6 and T8 form a current mirror circuit that mirrors the current I(T3). Transistor T8 outputs a current I(T8) corresponding to the current I(T3). In this embodiment, T6=T8 thus, I(T3)=I(T8).

Transistor T5 is in a voltage follower configuration. If transistor T5 is operated identically to transistor T3 then the voltage at output Vref is identical to the voltage at node 14. Resistors R1 and R3 provide an adjustment for changing the voltage at output Vref to be at the silicon bandgap voltage should transistors T3 and T5 be operated differently. The bandgap voltage across resistor R4 generates a current I(T5) which is conducted by transistor T5. In this example (for simplification) it is assumed that the beta of the bipolar transistors of voltage and current reference 11 are large enough to make the difference between collector and emitter currents negligible.

The current I(T8) is larger than the current I(T5). The current I(T5) is subtracted from the current I(T8) such that the remaining current of I(T8) is coupled to transistor T9 of current mirror 14. The current coupled to transistor T9 is mirrored to T10. In this example, transistors T9 and T10 have equal conductive area. An output current Iout equals the current coupled to transistor T9. Thus, the output current Iout is expressed by equation 1.

$$Iout=I(T8)-I(T5) \quad (1)$$

As mentioned previously, the current conducted by transistors T1 and T2 are equal. Transistor T3 provides current to both transistors T1 and T2, thus the current I(T3) of transistor T3 is equal to twice the current I(R2). The current I(T3)=2*I(R2) is conducted by transistor T6. In this example, transistors T6 and T8 are identical and in a current mirror configuration. The relationship between I(T8) and the current of the bandgap cell is described by equation 2.

$$I(T8)=I(T3)=2*I(R2) \quad (2)$$

The current through resistor R2 due to the base-emitter junction voltage difference between transistors T1 and T2 is described by equation 3. Vt is the thermal voltage of a bipolar transistor corresponding to kT/q where k is Boltzmann's constant, T is temperature, and q is the charge of an electron.

$$I(R2)=(Vt*\ln(N))/R2 \quad (3)$$

In this example, the voltage at output Vref is the silicon bandgap voltage (1.2605 volts). The current I(T5) is determined by resistor R4 and is shown by equation 4.

$$I(T5)=Vbandgap/R4 \quad (4)$$

The temperature coefficient of a current times the current magnitude yields a measure of the current temperature sensitivity. Equation 5 listed hereinbelow equates the current temperature sensitivity of currents I(T8) and I(T5). The result of equation 5 is to cancel temperature dependencies of current I(T8) with the current I(T5). The difference current (coupled to transistor T9) resulting from I(T5) being subtracted from I(T8) has a low temperature coefficient.

$$TC(I(T8))*I(T8)=TC(I(T5))*I(T5) \quad (5)$$

The temperature coefficient of the current I(T8) is dependent on two factors. First, the base-emitter junction voltage reduces in voltage magnitude as temperature increases. Second, the magnitude of resistor R2 increases as temperature increases. In the bandgap cell the temperature coefficients of base-emitter junction of transistor T4 and the voltage across resistor R1 are made to cancel at a predetermined temperature to generate a zero TC voltage. However, the current I(R2) conducted by the bandgap cell is not constant over temperature. The relationship between temperature coefficients corresponding to the current I(R2) is described in equation 6. The temperature coefficients of equation 6 correspond to the change in current over temperature due to transistor T1 and resistor R2 which are both known. The temperature coefficients will vary depending on the particular wafer process used.

$$TC(I(T8))=TC(T1)-TC(R2) \quad (6)$$

Rearranging equation 5 to solve for current I(T5) yields the expression in equation 7.

$$I(T5)=(TC(I(T8))/TC(R4))*I(T8) \quad (7)$$

Using the expression for I(T5) in equation 1 yields an expression for Iout as shown in equation 8.

$$Iout=I(T8)*(1-TC(I(T8))/TC(R4)) \quad (8)$$

The value of resistor R2 is calculated by using the relationships described in equations 2 and 3. The value of R2 in terms of the current I(T8) is described in equation 9.

$$R2=(Vt*\ln(N))/(0.5*(I(T8)) \quad (9)$$

The value for resistor R4 is equal the voltage at output Vref divided by the current I(T5) from equation 7. The expression for the value of resistor R4 is shown in equation 10.

$$R4=Vbandgap/I(T5) \quad (10)$$

The voltage at node 14 is calculated by starting at the output Vref. As mentioned previously, in this example the output voltage Vref=Vbandgap (bandgap voltage of silicon). The base-emitter junction voltages (Vbe) of transistors T3 and T5 are taken into account as shown in equation 11.

$$V(node\ 14)=Vbandgap+Vbe(T5)-Vbe(T3) \quad (11)$$

The base-emitter junction voltage (Vbe) of transistor T3 and T5 is calculated using equation 12.

$$Vbe=Vt*\ln(I/Is) \quad (12)$$

Vt is the thermal voltage of a bipolar transistor, I is the current conducted by the transistor, and Is is the saturation current which varies depending on the wafer process used.

In this example, the resistance of resistors R1 and R3 are equal and conduct equal currents. A resistance value for R1 and R3 is calculated from equation 13. Both transistors T1 and T2 conduct a current equal to I(R2).

$$R1=R3=(V(node\ 14)-Vbe(T2))/(I(R2)) \quad (13)$$

An example using real values helps illustrate a design of voltage and current reference 11. The circuit in which voltage and current reference 11 is used operates between temperatures −50 degrees Centigrade (C) and 150 degrees Centigrade. Optimal results are obtained by solving equations 1–11 at a temperature central to the operating range, for example 50 degrees Centigrade for the range listed above. Assume, an output voltage at Vref=1.2605 volts (silicon bandgap voltage) and an output current Iout=20 microamperes (ua) for voltage and current reference 11. Also, the TC of a base-emitter junction of a bipolar transistor is 3000 parts per million/degrees Centigrade (ppm/C), Is=$1.6*10^{-16}$ amperes, and the change in current due to a resistor is 4300 ppm/C. The transistor ratio (N) of transistors T1 and T2=8. The design of voltage and current reference 11 is solved as follows (the equation solved is shown in parentheses):

$$TC(T(T8))=3000\ ppm/C-4300\ ppm/C=-1300\ ppm/C; \quad (6)$$

$$\begin{aligned} I(T5) &= (-1300\ ppm/C/-4300\ ppm/C)*I(T8) \quad (7) \\ &= 0.302*I(T8); \end{aligned}$$

$$Iout=I(T8)*(1-0.302)=0.698*I(T8)=20\ ua \quad (1)$$

rearranging, $$I(T8)=20.000\ ua/0.698=28.653\ ua,$$

solving for I(T5) using equation 1, $$I(T5)=28.653\ ua-20.000\ ua=8.653\ ua;$$

$$R2=(Vt*\ln(N))/(0.5*(I(T8))=4{,}038\ ohms \quad (9)$$

where Vt @50 C=27.82 millivolts (mv) and N=8;

$$R4=1.2605\ volts/8.653\ ua=145{,}672\ ohms \quad (10)$$

$$I(T3)=I(T8)=28.653\ ua$$

$$I(R2)=I(T3)/2=14.327\ ua$$

$$Vbe(T5) = 27.82\ mv*\ln(8.653ua/1.6\times10^{-16}\ amperes) = 0.688\ volts \quad (12)$$

$$Vbe(T3) = 27.82\ mv*\ln(28.653ua/1.6\times10^{-16}\ amperes) = 0.721\ volts \quad (12)$$

$$V(node\ 14) = (1.2605+0.688-0.721)\ volts = 1.2275\ volts \quad (11)$$

$$Vbe(T2) = 27.82\ mv*\ln(14.327ua/1.6\times10^{-16}\ amperes) = .702\ volts \quad (12)$$

$$R1=R3 = (1.2275\ volts-0.702\ volts)/14.327ua = 36{,}679\ ohms \quad (13)$$

Bipolar transistors T3 and T5 are in a voltage follower configuration and could be replaced with MOSFET devices. Similarly, MOSFET transistors T6, T7, and T8 could be replaced with bipolar transistors.

A resistor R5 and transistors T11 and T12 form an alternate embodiment for current mirror circuit 14. Resistor R5 has a first terminal connected (via a dotted line) to node 17 and a second terminal connected to a node 18. Transistor T11 has a collector and base connected in common to node 18 and an emitter connected to ground. Transistor T12 has a collector connected to an output Iref2, a base connected to node 18, and an emitter connected to ground. A reference current is provided at the output Iref2. Resistor R5 produces a voltage drop to increase the voltage at node 17.

A diode D1 and transistors T13 and T14 form an alternate embodiment for current mirror circuit 14. Diode D1 has an anode connected (via a dotted line) to node 17 and a cathode connected to a node 19. Transistor T13 has a collector and base connected in common to node 19 and an emitter connected to ground. Transistor T14 has a collector connected to an output Iref3, a base connected to node 19, and an emitter connected to ground. A reference current is provided at output Iref3. Diode D1 produces a voltage drop to increase the voltage at node 17.

Figure 2:
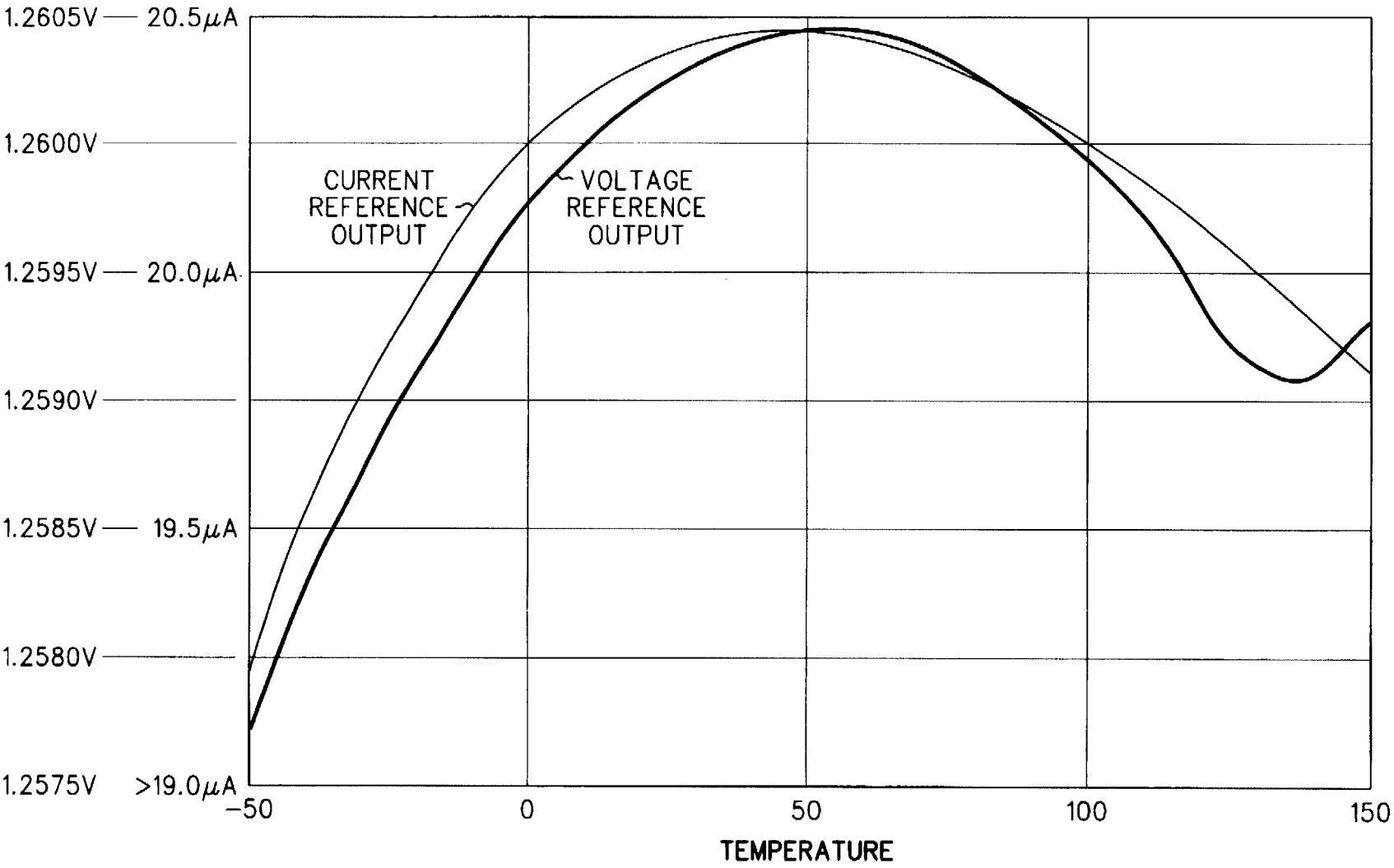
FIG. 2 is graph illustrating a simulation of a voltage and current reference described in FIG. 1.

FIG. 2 is graph illustrating simulation results of an example of voltage and current reference 11 of FIG. 1. Both current and voltage are indicated in FIG. 2. The results of the graph of FIG. 2 are from a transistor level simulation using values similar to the example described in FIG. 1. The graph is centered at 50 degrees centigrade with a temperature range of two hundred degrees centigrade. The voltage varies between 1.2577 volts and 1.2605 volts (2.8 millivolt variation) over the temperature range. The current varies between 19.25 microamperes and 20.50 microamperes (1.25 microampere) over the temperature range.

By now it should be appreciated that a voltage and current reference circuit has been provided. The voltage and current reference circuit has a low temperature coefficient and has a minimum component count to reduce die area used by the circuit. A voltage reference generates a reference voltage in the circuit. A current from the voltage reference is used to generate a current reference. The temperature coefficient of the current from the voltage reference is known. A resistor is biased by the reference voltage of the voltage reference. The current generated by the resistor and reference voltage has a temperature coefficient corresponding to the temperature coefficient from the voltage reference. The current generated by the resistor is subtracted from the current from the voltage reference. The temperature dependencies of the two currents cancel one another. The remaining current of the current from the voltage reference has a low temperature coefficient. The remaining current is coupled to a current mirror and the mirrored current is provided as the reference current.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention.

I claim:

1. A voltage and current reference circuit comprising:

a first resistor having a first terminal and a second terminal;

a first transistor of a first conductivity type having a first electrode coupled to said second terminal of said first resistor, a control electrode, and a second electrode;

a second resistor having a first terminal coupled to said second electrode of said first transistor and a second terminal coupled to a first power supply terminal for receiving a first power supply voltage;

a second transistor of said first conductivity type having a first electrode and a control electrode coupled in common to said control electrode of said first transistor, and a second electrode coupled to said first power supply terminal;

a third resistor having a first terminal coupled to said first terminal of said first resistor and a second terminal coupled to said first electrode of said second transistor;

a third transistor of said first conductivity type having a first electrode, a control electrode, and a second electrode coupled to said first terminal of said first resistor;

a fourth transistor of said first conductivity type having a first electrode coupled to said control electrode of said third transistor, a control electrode coupled to said second terminal of said first resistor, and a second electrode coupled to said first power supply terminal;

a fifth transistor of said first conductivity type having a first electrode, a control electrode coupled to said control electrode of said third transistor, and a second electrode coupled to a voltage reference output of the voltage and current reference circuit;

a fourth resistor having a first terminal coupled to the voltage reference output and a second terminal coupled to said first power supply terminal;

a sixth transistor of a second conductivity type having a first electrode and a control electrode coupled in common to said first electrode of said third transistor, and a second electrode coupled to a second power supply terminal for receiving a second power supply voltage;

a seventh transistor of said second conductivity type having a first electrode coupled to said control electrode of said third transistor, a control electrode coupled to said control electrode of said sixth transistor, and a second electrode coupled to said second power supply terminal;

an eighth transistor of said second conductivity type having a first electrode coupled to said first electrode of said fifth transistor, a control electrode coupled to said control electrode of said sixth transistor, and a second electrode coupled to said second power supply terminal;

a ninth transistor of said first conductivity type having a first electrode and a control electrode coupled in common to said first electrode of said eighth transistor, and a second electrode coupled to said first power supply terminal; and a tenth transistor of said first conductivity type having a first electrode coupled to a current reference output of the voltage and current reference circuit, a control electrode coupled to said control electrode of said ninth transistor, and a second electrode coupled to said first power supply terminal.

2. The voltage and current reference circuit as recited in claim 1 further including a resistor coupled between said first electrode of said eighth transistor and said first electrode of said ninth transistor.

3. The voltage and current reference circuit as recited in claim 1 further including a diode having an anode coupled to said first electrode of said eighth transistor and a cathode coupled to said first electrode of said ninth transistor.

4. The voltage and current reference circuit as recited in claim 1 wherein said ninth and tenth transistors are Metal Oxide Semiconductor Field Effect Transistors (MOSFETs).

5. The voltage and current reference circuit as recited in claim 1 wherein said ninth and tenth transistors are bipolar transistors.

6. The voltage and current reference circuit as recited in claim 1 wherein said first and second transistors are bipolar transistors and wherein said first transistor has a conductive area N times larger than a conductive area of said second transistor.

7. A voltage and current reference circuit having a first output node and a second output node for providing a reference voltage and a reference current comprising:

a voltage reference cell for generating the reference voltage;

a buffer cell coupled to said voltage reference cell for providing the reference voltage to the first output node, the buffer cell comprising:

a first transistor of a first conductivity type having a first electrode, a control electrode and a second electrode coupled to said voltage reference cell; and a second transistor of said first conductivity type having a first electrode, a control electrode coupled said control electrode of said first transistor, and a second electrode coupled to said first output node for providing the reference voltage;

a current mirror cell coupled to said first electrodes of said first and second transistors of said buffer cell for generating a first current and providing the reference current to the second output node; and a resistor having a first terminal coupled to said second electrode of said second transistor of said buffer cell and a second terminal coupled to a first power supply terminal wherein said resistor generates a second current.

8. The voltage and current reference circuit of claim 7 wherein a magnitude of said first current is greater than a magnitude of said second current and wherein said second current is subtracted from said first current to produce the reference current such that said reference current couples to said second output node.

9. The voltage and current reference circuit of claim 8 wherein said voltage reference cell is a bandgap voltage reference cell.

10. The voltage and current reference circuit of claim 9 wherein said voltage reference cell comprises:

a first resistor having a first terminal coupled to said second electrode of said first transistor of said buffer cell and a second terminal;

a third transistor of said first conductivity type having a first electrode coupled to said second terminal of said first resistor, a control electrode, and a second electrode;

a second resistor having a first terminal coupled to said second electrode of said third transistor and a second terminal coupled to said first power supply terminal;

a fourth transistor of said first conductivity type having a first electrode and a control electrode coupled in common to said control electrode of said third transistor, and a second electrode coupled to said first power supply terminal;

a third resistor having a first terminal coupled to said first terminal of said first resistor and a second terminal coupled to said first electrode of said fourth transistor; and a fifth transistor of said first conductivity type having a first electrode coupled to said control electrode of said first transistor, a control electrode coupled to said second terminal of said first resistor, and a second electrode coupled to said first power supply terminal; and wherein said current mirror cell comprises:

a sixth transistor of a second conductivity type having a first electrode and a control electrode coupled in common to said first electrode of said first transistor, and a second electrode coupled to a second power supply terminal;

a seventh transistor of said second conductivity type having a first electrode coupled to said control electrode of said first transistor, a control electrode coupled to said control electrode of said sixth transistor, and a second electrode coupled to said second power supply terminal; and an eighth transistor of said second conductivity type having a first electrode coupled to said first electrode of said second transistor, a control electrode coupled to said control electrode of said sixth transistor, and a second electrode coupled to said second power supply terminal.

11. The voltage and current reference circuit as recited in claim 10 wherein said third and fourth transistors of said voltage reference cell are bipolar transistors and wherein said third transistor has a conductive area N times larger than a conductive area of said fourth transistor.

12. The voltage and current reference circuit as recited in claim 11 wherein said first, second, sixth, seventh, and eighth transistors are bipolar transistors.

13. The voltage and current reference circuit as recited in claim 11 wherein said first, second, sixth, seventh, and eighth transistors are Metal Oxide Semiconductor Field Effect Transistors (MOSFETs).

14. The voltage and current reference circuit as recited in claim 11 further comprising a current mirror circuit having a first terminal coupled to said second output node and a second terminal, wherein said current mirror circuit comprises:

a first current mirror transistor of said first conductivity type having a first electrode and a control electrode coupled in common to said first terminal of said current mirror circuit for receiving the reference current and a second electrode coupled to said first power supply terminal; and a second current mirror transistor of said first conductivity type having a first electrode coupled to said second terminal of said current mirror circuit for providing a mirrored reference current, a control electrode coupled to said control electrode of said first current mirror transistor, and a second electrode coupled to said first power supply terminal.

15. The voltage and current reference circuit as recited in claim 14 wherein said current mirror circuit further includes a current mirror resistor coupled between said first terminal of said current mirror circuit and said first electrode of said first current mirror transistor.

16. The voltage and current reference circuit as recited in claim 14 wherein said current mirror circuit further includes a diode having an anode coupled to said first terminal of said current mirror circuit and a cathode coupled to said first electrode of said first current mirror transistor.

17. The voltage and current reference circuit as recited in claim 14 wherein said first and second current mirror transistors of said current mirror circuit are Metal Oxide Semiconductor Field Effect Transistors (MOSFETs).

18. The voltage and current reference circuit as recited in claim 14 wherein said first and second current mirror transistors of said current mirror circuit are bipolar transistors.

19. A method for generating a reference voltage and reference current comprising the steps of:

generating an initial reference voltage;

generating the reference voltage based on said initial reference voltage;

providing isolation between said initial reference voltage and said reference voltage;

generating a first current having a known temperature coefficient;

supplying said reference voltage to a resistor to generate a second current;

subtracting said second current from said first current wherein said second current cancels changes in said first current due to temperature; and providing remaining current of said first current as the reference current having a temperature coefficient less than the known temperature coefficient of said first current.

* * * * *